United States Patent [19]

Van Steenhoven et al.

[11] 4,162,779

[45] Jul. 31, 1979

[54] OUTLET BOX MOUNTING DEVICE

[75] Inventors: Frank Van Steenhoven, Killingworth; Thomas D. Hirt, Meriden, both of Conn.

[73] Assignee: The Miller Company, Meriden, Conn.

[21] Appl. No.: 860,596

[22] Filed: Dec. 14, 1977

[51] Int. Cl.[2] ..... B42F 13/00

[52] U.S. Cl. ..... 248/343; 362/404

[58] Field of Search ..... 248/343, 342; 52/39; 362/404, 406; 220/3.6, 3.5, 3.3, 3.4, 3.9, 3.92

[56] References Cited

U.S. PATENT DOCUMENTS

| | | | |
|---|---|---|---|
| 1,742,438 | 1/1930 | D'Olier | 362/404 X |
| 2,532,528 | 12/1950 | Zuley | 362/404 X |
| 2,569,859 | 10/1951 | Locke | 248/343 X |
| 2,602,623 | 7/1952 | Sperry | 248/343 |
| 3,459,399 | 8/1969 | Everson | 52/39 X |

FOREIGN PATENT DOCUMENTS

| | | | |
|---|---|---|---|
| 295322 | 5/1954 | Switzerland | 362/404 |
| 643226 | 9/1950 | United Kingdom | 248/343 |
| 707613 | 4/1954 | United Kingdom | 362/404 |

*Primary Examiner*—J. Franklin Foss

*Attorney, Agent, or Firm*—Hayes and Reinsmith

[57] ABSTRACT

A light fixture mounting device is disclosed wherein a service outlet box has a mounting adaptor with light fixture suspension means providing temporary suspension of a light fixture during installation and connection of the electrical wiring and subsequent maintenance.

15 Claims, 6 Drawing Figures

OUTLET BOX MOUNTING DEVICE

This invention generally relates to electrical light fixtures and particularly concerns a mounting device for such fixtures.

A primary object of this invention is to provide a new and improved light fixture mounting device which significantly facilitates installation and connection of electrical wiring by temporary suspension of the light fixture in its entirety as a unit from a mounting adaptor secured to a service outlet box.

Another object of this invention is to provide such a light fixture mounting device which not only is quick and easy to install but is particularly designed to effect releasable locking of the light fixture in a final assembly position.

Yet another object of this invention is to provide a new and improved light fixture mounting device which is quick and easy to manufacture in low-cost production quantities and which will provide reliable service over an extended period of time with minimum maintenance requirements.

Other objects will be in part obvious and in part pointed out in more detail hereinafter.

A better understanding of the objects, advantages, features, properties and relations of this invention will be obtained from the following detailed description and accompany drawings which set forth an illustrative embodiment and are indicative of the ways in which the principles of this invention are employed.

Figure 1:
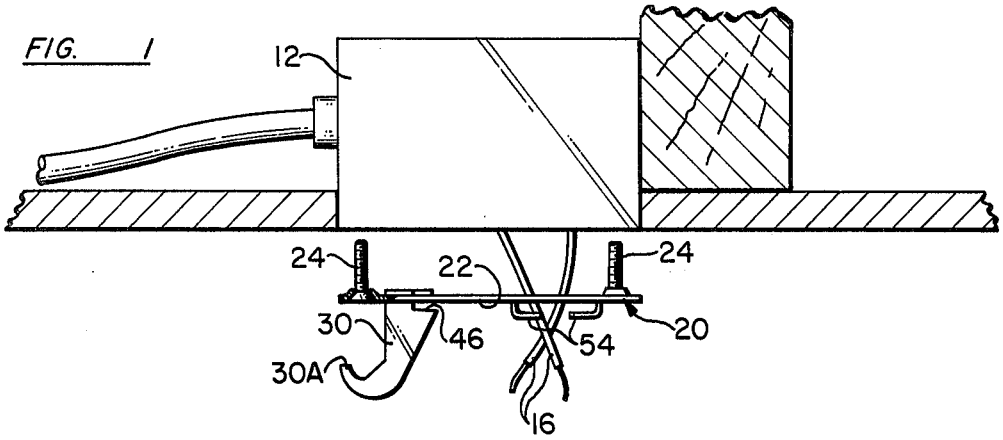
FIG. 1 is a side elevational view, partly broken away and partly in section, showing a service outlet box and a mounting adaptor of this invention.

Referring to the drawings in detail, a light fixture mounting device 10 is illustrated which includes a conventional service outlet box 12, shown in a typical overhead installation, and a light fixture 14. Before securing light fixture 14 in permanent position or final assembly position (FIG. 6) in underlying fixed relation to outlet box 12, electrical wiring 16 extending from outlet box 12 must be connected to electrical wiring 18 of light fixture 14. Overhead installations of this type conventionally have been awkward and difficult to install and service, particularly when a workman must be balanced at or near the top of a ladder while making the necessary electrical connections to the light fixture 14 which due to the normally short length of its electrical wires must be maintained in close proximity to the outlet box 12 during such servicing.

In accordance with one of the features of this invention, outlet box 12 is provided with a mounting adaptor 20 which not only serves as a cover plate for the bottom of outlet box 12 but additionally provides means for temporarily suspending light fixture 14, thereby freeing the hands of the workman during installation to make the necessary wiring connections as well as during subsequent service maintenance when so required.

More specifically, the mounting adaptor 20 comprises a plate 22 which is suitably dimensioned and shaped to conform to the bottom of outlet box 12 to which adaptor 20 is to be attached. Fasteners, such as screws 24, are received in openings 26 and threadably engaged within suitably aligned openings, not shown, in the bottom of outlet box 12 to fix mounting adaptor 20 in position. Electrical wiring 16 extending from outlet box 12 is brought through an opening 28 in mounting adaptor 20 for connection to wires 18 extending from light fixture 14.

Figure 2:
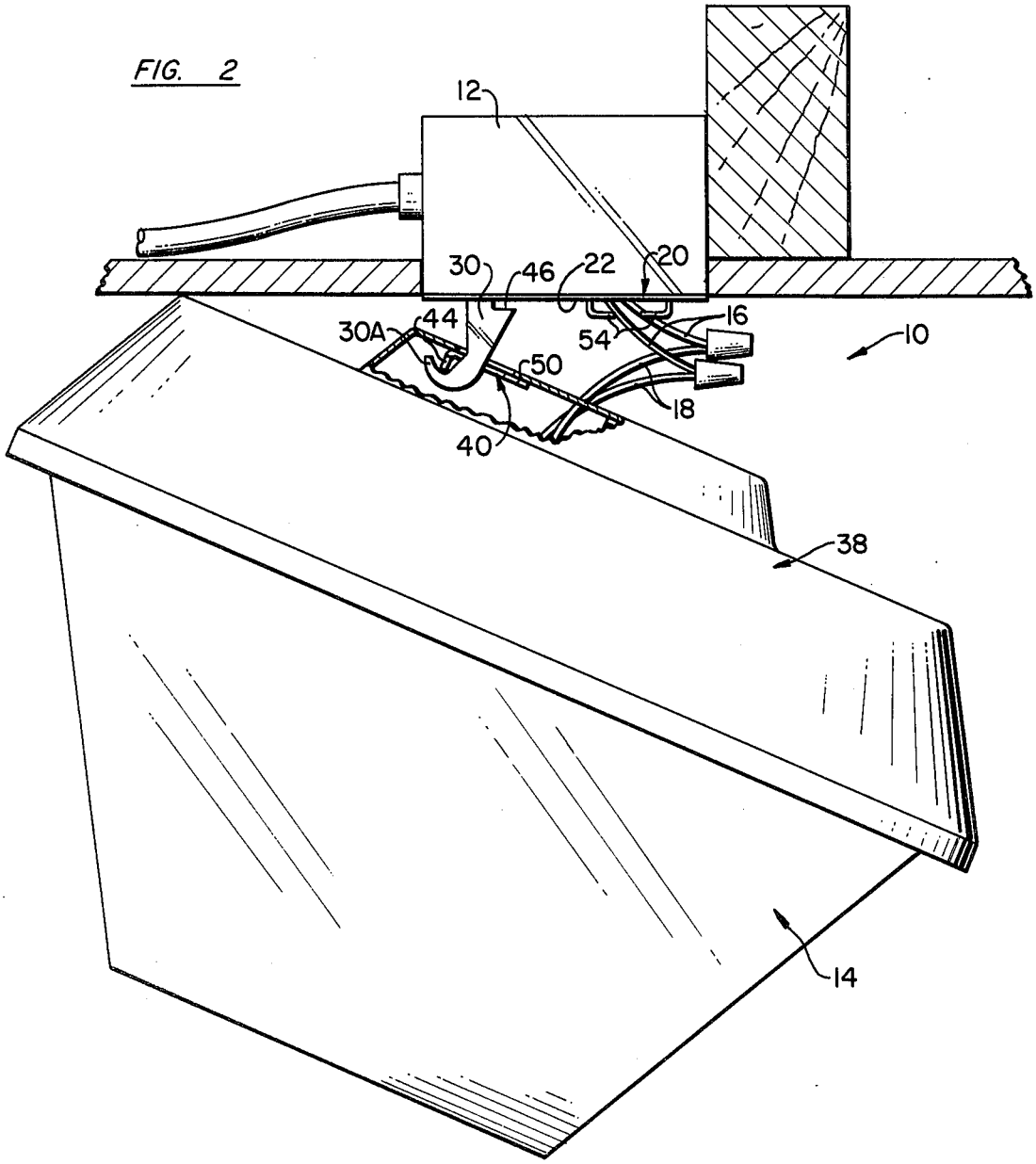
FIG. 2 is a side elevational view similar to that shown in FIG. 1, partly broken away and partly in section, showing the outlet box and mounting adaptor installed in position with a light fixture suspended in a temporary position.

In the specifically illustrated embodiment, the mounting adaptor 20 has affixed thereto a pair of depending arms 30,32 which are received in registering openings or slots 34,36 provided in an upper housing 38 of the light fixture 14 for engaging that light fixture and temporarily suspending it. Preferably, a mounting plate 40 is fixed, e.g., by rivets 42 to an inside face of the upper housing 38, and an integral lip 44 depending from the mounting plate 40 serves to engage upturned fingers 30A,32A of the arms 30,32 (FIG. 2) to prevent inadvertent disengagement of light fixture 14 while the wires are being connected with the light fixture 14 disposed in a temporary suspended position in angularly offset relation to the mounting adaptor 20. The arms 30,32 are shown as being formed of flat strip stock to extend downwardly from the mounting adaptor 20 in parallel spaced relation to one another.

Figure 3:
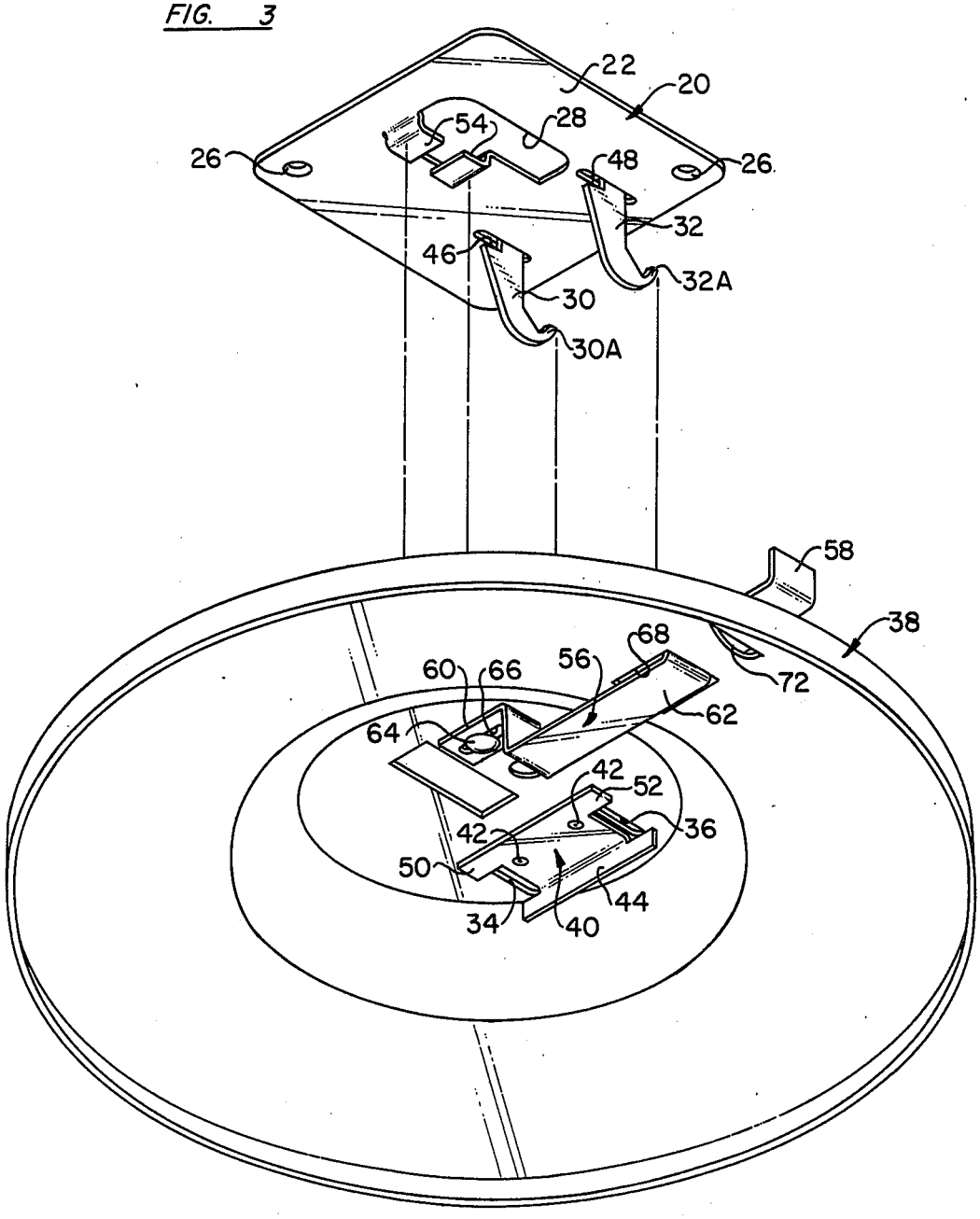
FIG. 3 is an isometric view, partly broken away, showing the outlet box mounting adaptor in disassembled relation to an upper light fixture housing.
Figure 4:
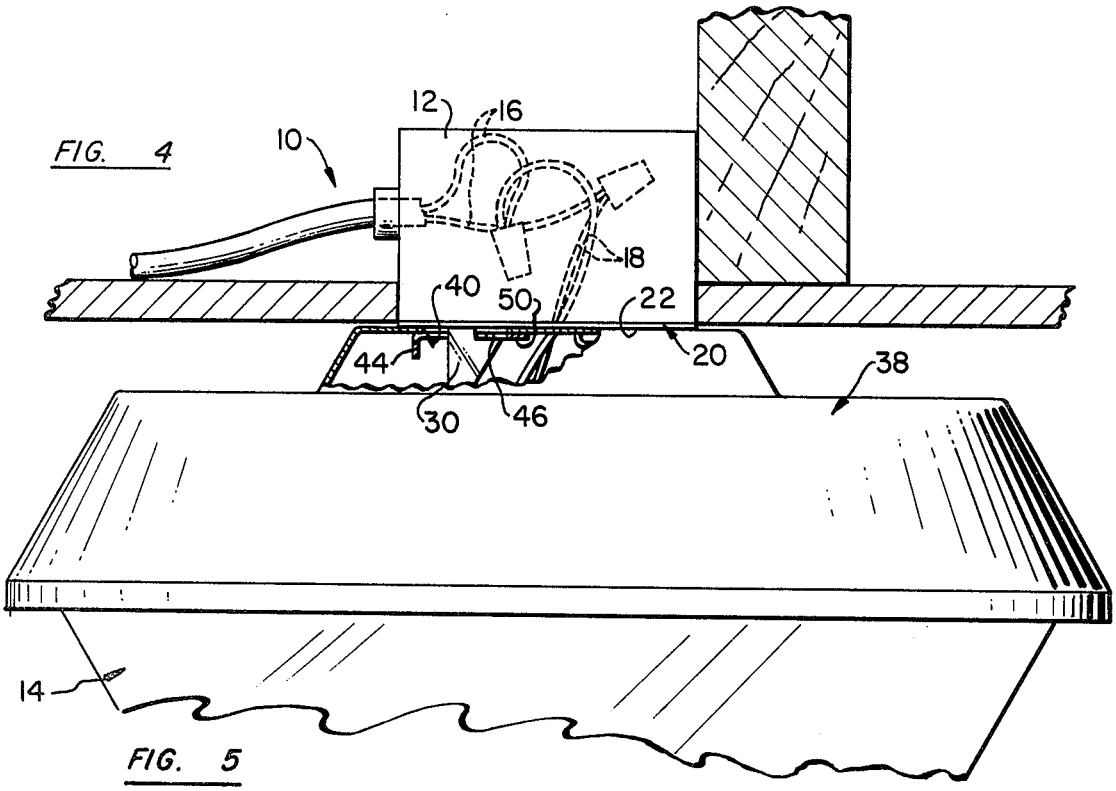
FIG. 4 is a view similar to FIG. 2, partly broken away and partly in section, showing the light fixture in a flush aligned position relative to the outlet box prior to being moved into a final assembly position.

To effect flush seating of light fixture 14 against mounting adaptor 20, each of the arms 30,32 are provided with slots 46,48 in underlying relation to the mounting adaptor 20 on a side of each of the arms 30,32 opposite their respective upturned fingers 30A,32A. Accordingly, upon effecting the electrical wiring connections and upon inserting the wires 16,18 through mounting adaptor opening 28 and into outlet box 12, the light fixture 14 may be rotated from its temporary suspended position (FIG. 2) to a flush aligned position (FIGS. 4 and 5) wherein tabs 50,52 (FIG. 3) of the mounting plate 40 are disposed in confronting relation to slots 46,48 of the mounting adaptor arms 30,32. The light fixture 14 then may be moved from its flush aligned position into a permanent or final assembly position upon shifting the light fixture 14 to the left of its position illustrated in FIG. 4 such that the tabs 50,52 of mounting plate 40 of the light fixture upper housing 38 are received respectively in the slots 46,48 of the arms 30,32 in engagement with the mounting adaptor 20.

Figure 5:
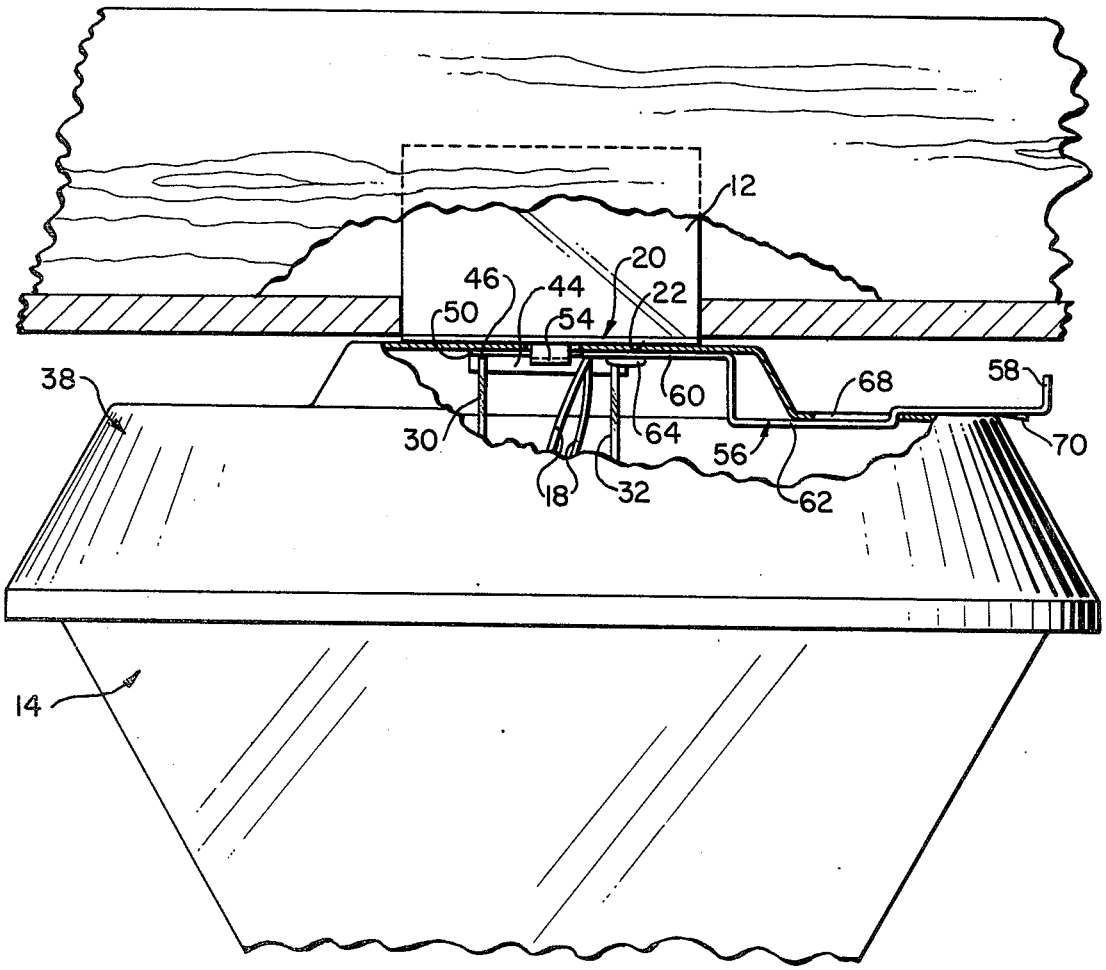
FIG. 5 is a view of the assembly of FIG. 4, partly broken away and partly in section, taken at right angles to that shown in FIG. 4.
Figure 6:
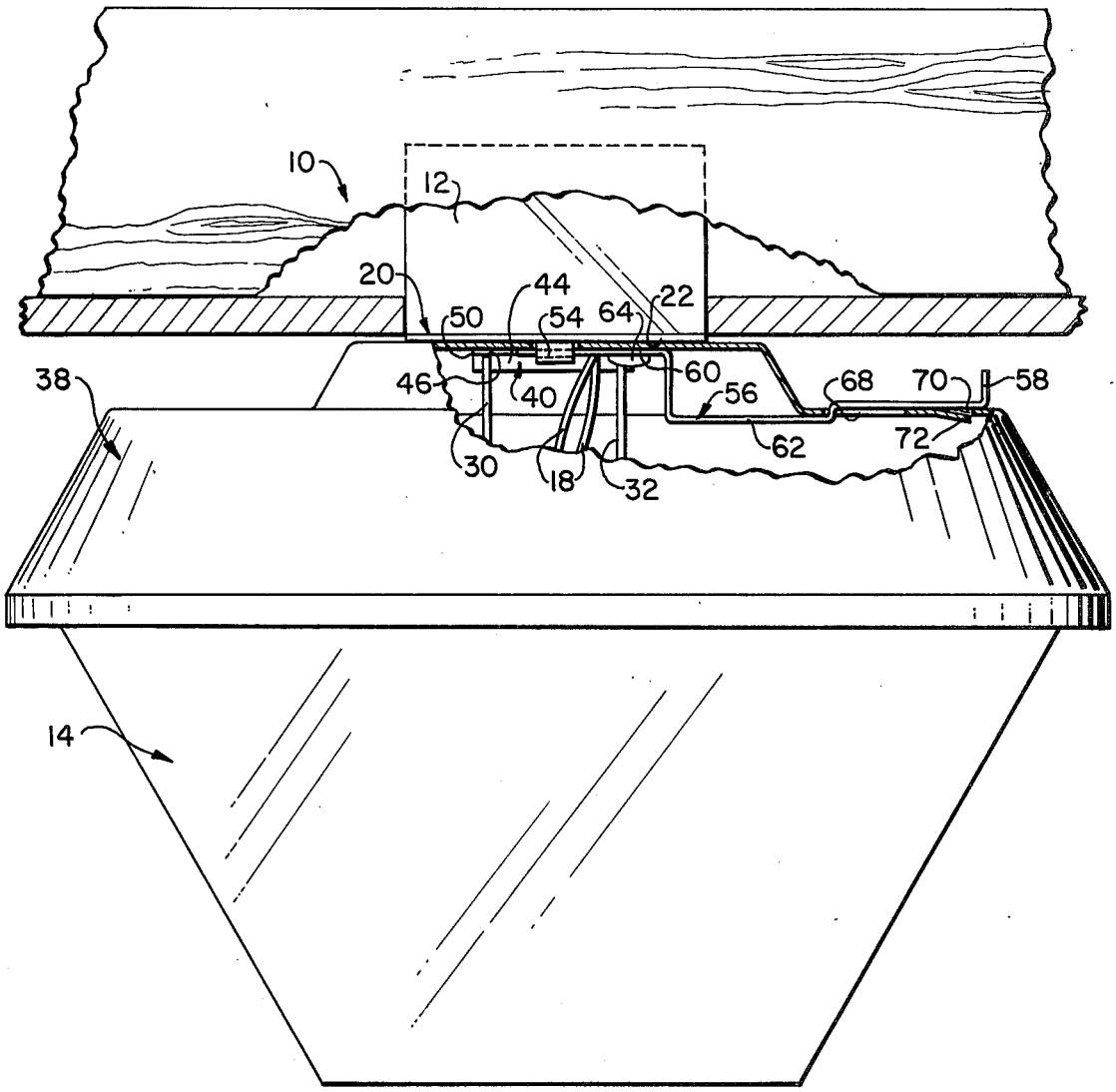
FIG. 6 is a view similar to FIG. 5 showing the light fixture in its final assembly position in relation to the outlet box and mounting adaptor.

To provide permanent light fixture mounting, a light fixture locking means is illustrated which includes a bolt keeper 54 mounted on the mounting adaptor 20 and a slide bolt 56 movable between a release position (FIG. 5) and a lock position (FIG. 6). To insure appropriate light fixture disengagement for maintenance or service purposes, the locking means is also designed to be releasable. More specifically, slide bolt 56 is shown as being formed from flat bar stock having an upturned handle end 58, a relatively raised locking end 60, and an intermediate connector portion 62 between the ends 58,60. In the illustrated embodiment, intermediate connector portion 62 is shown offset and in depending relation to the two ends 58,60 of slide bolt 56. To support slide bolt 56 for sliding movement, a shoulder rivet 64 is illustrated in the preferred embodiment and will be understood to be secured to upper housing 38 of light fixture 14 to extend through an elongated slot 66 in the locking end 60 of slide bolt 56 with the head of the rivet 64 supporting the bolt for sliding movement on the fixture 14. A slide bolt opening 68 is formed in upper housing 38 through which intermediate connector portion 62 of the slide bolt 56 extends in underlying relation to the upper housing 38 generally toward the center of the light fixture housing 38.

By virtue of the above described construction, when the light fixture housing 38 is moved from its flush aligned position (FIGS. 4 and 5) into final assembly position (FIG. 6), the locking end 60 of slide bolt 56 is brought into registration with the keeper 54 of the mounting adaptor 20 whereupon the slide bolt 56 may be simply moved from its illustrated release position in FIG. 5, to the left as viewed in FIG. 5 of the drawings, to assume the lock position (FIG. 6) wherein the locking end 60 of slide bolt 56 is received between the confronting depending arms of the mounting adaptor keeper 54. To prevent inadvertent disengagement of the light fixture 14 from its locked final assembly position, catch means is provided. In the specifically illustrated embodiment a lance 70 is formed in the slide bolt 56 adjacent its handle end 58 to project downwardly. Lance 70 moves into a corresponding housing lance opening 72 upon moving the bolt 56 to lock position whereupon elements 70 and 72 serve as locking catch means to prevent any accidental return of the slide bolt 56 into release position. Slide bolt opening 68 in the upper housing 38 is at all times effectively covered by the slide bolt itself, and with the slide bolt 56 in lock position, the slide bolt 56 is also effectively concealed by the upper housing 38 of light fixture 14 which additionally conceals the service outlet box mounting adaptor 20.

From the foregoing description, it will be seen that the locking end 60 of the slide bolt 56 may be moved away from its lock position in locking engagement with the keeper 54. I.e., after slide bolt handle 58 has been raised to permit its lance 70 to clear the housing 38, the slide bolt 56 may be moved to the right, as viewed in FIG. 6, to return the slide bolt 56 into its release position (FIG. 5). With the slide bolt 56 in release position, the light fixture housing 14 may be simply disengaged from mounting adaptor 20 upon pulling the light fixture as a unit away from the slotted side of the mounting adaptor arms 30,32 and thereupon permit rotation of the light fixture 14 downwardly into its temporary position (FIG. 2) for subsequent servicing. Thereafter, the light fixture 14 is rotatable between its suspended and flush aligned positions about an axis extending in generally parallel spaced relation to the axis of movement of the slide bolt 56 and into flush aligned position prior to being moved into final assembly position wherein the slide bolt 56 is driven home into keeper 54 to lock position, thereby once again securing the light fixture 14 in a permanent position.

As will be apparent to persons skilled in the art, various modifications, adaptations and variations of the foregoing specific disclosure can be made without departing from the teachings of this invention.

We claim:

1. A light fixture mounting device comprising a service outlet box having a bottom cover plate, light fixture suspension means on the bottom cover plate providing temporary light fixture suspension, a light fixture having an upper housing in underlying relation to the bottom cover plate, and light fixture locking means including a bolt keeper depending from the bottom cover plate and releasable slide bolt means on the upper housing, the bolt keeper and slide bolt means cooperating and providing permanent light fixture mounting when the upper housing of the light fixture is in aligned confronting relation to the bottom cover plate.

2. The device of claim 1 wherein the locking means is releasable for light fixture disengagement for servicing.

3. The device of claim 1 wherein the slide bolt is movable between a release position and a lock position, wherein the slide bolt in release position is disengaged from the keeper during temporary light fixture suspension, and wherein the slide bolt in lock position is engaged with the keeper for permanent light fixture mounting.

4. A light fixture mounting device comprising a service outlet box mounting adaptor, light fixture suspension means on the mounting adaptor providing temporary light fixture suspension, light fixture locking means cooperating with the mounting adaptor providing permanent light fixture mounting, a light fixture having an upper housing with a pair of openings formed therein, said suspension means comprising a pair of arms depending from the mounting adaptor and extending through the pair of openings in the light fixture housing for engaging and temporarily suspending the light fixture, the mounting adaptor arms each having a slot therein in underlying relation to the mounting adaptor, the light fixture being rotatable on the mounting adaptor arms between a temporary suspended position in angularly offset relation to the mounting adaptor and a flush aligned position in confronting relation to the slots of the mounting adaptor arms, and the light fixture being movable between said flush aligned position and a permanent position wherein the light fixture housing is received in the slots of the arms in engagement with the mounting adaptor.

5. The device of claim 4 wherein the light fixture in permanent position conceals the service outlet box mounting adaptor.

6. A light fixture mounting device comprising a service outlet box mounting adaptor, light fixture suspension means on the mounting adaptor providing temporary light fixture suspension, light fixture locking means cooperating with the mounting adaptor providing permanent light fixture mounting, the light fixture locking means including a bolt keeper mounted on the mounting adaptor and a slide bolt movable between a release position and a lock position, the slide bolt in release position being disengaged from the keeper during temporary light fixture suspension, the slide bolt in lock position being engaged with the keeper for permanent light fixture mounting, and a light fixture having an upper housing, the slide bolt being mounted for sliding movement on the upper housing of the light fixture, and the slide bolt and upper housing of the light fixture having cooperating catch means for releasably securing the bolt in lock position.

7. A light fixture mounting device comprising a service outlet box mounting adaptor, light fixture suspension means on the mounting adaptor providing temporary light fixture suspension, light fixture locking means cooperating with the mounting adaptor providing permanent light fixture mounting, the light fixture locking means including a bolt keeper mounted on the mounting adaptor and a slide bolt movable between a release position and a lock position, the slide bolt in release position being disengaged from the keeper during temporary light fixture suspension, the slide bolt in lock position being engaged with the keeper for permanent light fixture mounting, and a light fixture having an upper housing with a slide bolt opening, the slide bolt including a handle end, an opposite locking end and an intermediate connector portion in depending offset relation to its handle end, the handle end of the slide bolt being in overlying relation to the housing adjacent its periphery, the slide bolt being received within the slide bolt opening in the housing with the intermediate connector portion of the slide bolt extending generally toward the center of the housing in underlying relation to the housing.

8. The device of claim 7 wherein one of the housing and locking end members has an elongated slot therein, wherein the other of the housing and locking end members has a fastener secured thereto to extend through said elongated slot for supporting the slide bolt for sliding movement between its release and lock positions.

9. The device of claim 7 wherein the slide bolt substantially covers the slide bolt opening in the light fixture housing in both release and lock positions and slide bolt positions therebetween.

10. The device of claim 7 wherein the upper housing of the light fixture has a pair of openings formed therein, wherein said suspension means comprises a pair of arms mounted on and depending from the mounting adaptor and projecting through the pair of openings in the light fixture housing, wherein the mounting adaptor arms each have a slot therein in underlying relation to the mounting adaptor, wherein the light fixture is rotatable in its entirety as a unit on the mounting adaptor arms between a temporary suspended position in angularly offset relation to the mounting adaptor and a flush aligned position in confronting relation to the slots of the mounting adaptor arms, and wherein the light fixture is movable between said flush aligned position and a permanent position wherein the light fixture housing is received within the slots of the arms in engagement with the mounting adaptor.

11. The device of claim 10 wherein the light fixture is rotatable between said suspended and aligned positions about an axis extending in generally parallel spaced relation to the axis of movement of the slide bolt.

12. The device of claim 10 wherein the locking end of the slide bolt registers with the keeper of the mounting adaptor when the light fixture is in permanent position.

13. The device of claim 12 wherein the locking end of the slide bolt is movable toward and away from releasable locking engagement with the keeper responsive to movement of the slide bolt between lock and release positions when the light fixture is in permanent position.

14. A light fixture mounting device comprising a service outlet box mounting adaptor including a service outlet box cover plate, light fixture suspension means on the mounting adaptor providing temporary light fixture suspension, a light fixture having an upper housing with at least one opening in underlying relation to the mounting adaptor, the light fixture suspension means including at least one arm fixed to and depending from the service outlet box cover plate, the arm being received within the opening of the light fixture housing for temporarily suspending the same during installation and connection of electrical wiring, and light fixture locking means including releasable slide bolt means on the upper housing cooperating with the mounting adaptor providing permanent light fixture mounting.

15. A light fixture mounting device comprising a service outlet box mounting adaptor, a light fixture having an upper housing with a pair of openings formed therein in underlying relation to the mounting adaptor, a pair of arms depending from the mounting adaptor and extending through the pair of openings in the light fixture housing for engaging and temporarily suspending the light fixture, and light fixture locking means including releasable slide bolt means on the upper housing cooperating with the mounting adaptor providing permanent light fixture mounting.

* * * * *